United States Patent [19]

Pasic

[11] 4,312,266

[45] Jan. 26, 1982

[54] OBJECT-TURNING APPARATUS FOR A HIGH-SPEED STRAPPING MACHINE

[75] Inventor: James A. Pasic, Montesano, Wash.

[73] Assignee: Ovalstrapping, Inc., Hoquiam, Wash.

[21] Appl. No.: 232,012

[22] Filed: Feb. 6, 1981

Related U.S. Application Data

[63] Continuation-in-part of Ser. No. 154,754, May 30, 1980, abandoned.

[51] Int. Cl.[3] ..... B65B 13/04

[52] U.S. Cl. ..... 100/7; 100/4; 100/14; 100/26; 198/411

[58] Field of Search ..... 100/4, 7, 14, 26; 198/406, 411, 414

[56] References Cited

U.S. PATENT DOCUMENTS

| | | | |
|---|---|---|---|
| 2,723,743 | 11/1955 | Carter | 198/411 |
| 2,850,963 | 9/1958 | Grebe | 100/14 X |
| 3,174,631 | 3/1965 | Swihart | 100/26 X |
| 3,783,773 | 1/1974 | Willard | 100/7 |
| 3,901,138 | 8/1975 | Van de Bilt | 100/7 |
| 4,120,239 | 10/1978 | Pasic | 100/32 |
| 4,201,127 | 5/1980 | Pasic | 100/7 |

FOREIGN PATENT DOCUMENTS 926776 4/1955 Fed. Rep. of Germany .

*Primary Examiner*—Billy J. Wilhite

*Attorney, Agent, or Firm*—Seed, Berry, Vernon & Baynham

[57] ABSTRACT

An object is deposited at a strapping station on a high-speed, rapidly accelerating conveyor having a high-friction conveying surface. The object is raised off the high-friction surface by spaced tables having low-friction surfaces. Spaced, vertically downwardly extending bars engage opposite halves of opposite sides of the object and simultaneously move those halves transversely so as to rotate the object ninety degrees on the low-friction tables. A first strap is placed around the object before it is rotated; a second strap is placed around the object after it is rotated ninety degrees; then the conveyor accelerates the cross-strapped object rapidly out of the strapping station.

16 Claims, 16 Drawing Figures

OBJECT-TURNING APPARATUS FOR A HIGH-SPEED STRAPPING MACHINE

CROSS-REFERENCE TO RELATED APPLICATIONS

This application is a continuation-in-part application of U.S. patent application Ser. No. 154,754, filed May 30, 1980, now abandoned.

TECHNICAL FIELD

This invention pertains to strapping machines and, more particularly, to devices for rapidly and accurately rotating a strapped object ninety degrees for placement of a cross-strap around the object.

BACKGROUND ART

It is frequently advantageous to place a second strap on an object, such as a bundle of newspapers, at right angles to the first strap. Heretofore, rotating the object often has been done at a station remote from the strapping station since it is difficult to fit the necessary rotating components into the highly complex machinery of the strapping apparatus. U.S. Pat. No. 3,901,138 shows a typical bundle-rotating device remote from a strapping station. The disadvantage with this type of bundle-rotating device is that it requires moving the bundle out of the strapping station for the purpose of rotating the bundle. This movement of the bundle requires considerable time and defeats the purpose of high-speed strapping machines in which the bundle is delivered to the strapping station and removed at extremely high rates of speed and the straps are placed on the bundle at the strapping station in less than a second. A strapping machine capable of doing such rapid strapping and movement of the bundle into and out of the strapping station, for example, is shown and described in U.S. Pat. Nos. 4,120,239 and 4,201,127 (the subject matter of both patents being incorporated by reference into this description).

Other known types of rotating apparatus are shown in U.S. Pat. Nos. 2,850,963 and 3,783,773. Both devices are complicated in operation and require a considerable amount of time for rotating the object to be strapped. In particular, the structure of U.S. Pat. No. 2,850,963 requires rotation of the object, followed by repositioning of the object, which, during its initial rotation, can be skewed out of proper alignment on the conveyor. Furthermore, the delivery to and removal from the strapping station is umbersome and time consuming.

Another machine uses a pair of opposed pushers which engage opposite sides of the object at forward and rearward halves and rotate the bundle directly on the conveyor, which has a relatively slippery surface for this purpose. Rotation by the use solely of these opposed pushers is slow. This type of machine is also limited in its ability to convey a bundle rapidly.

DISCLOSURE OF INVENTION

This invention provides a bundle-turning device which is simple in operation and useful at a strapping station on a high-speed strapping machine. The device simultaneously rotates and positions a bundle or stack at a strapping station. It is especially useful at a station which carries the object on a rapidly accelerated high-friction conveying surface to a strapping station.

Basically, the device operates by moving the object to the strapping station on a high-speed, high-friction conveyor, lifting the object off the high-friction surface onto a low-friction surface, extending vertical, opposed turning posts or bars to move simultaneously against opposite, transversely spaced sides at opposite halves of the object, and rotating the object ninety degrees against a positive stop, which is either a part of the turning post or an independent post. The stop provides triangulation or three-point engagement on the bundle to assure that the bundle can be rotated at maximum rotational velocity at the end of its turn, yet stop in the correct orientation for strapping. Maintaining maximum rotational velocity throughout the turn assures that the output requirements of the strapping machine are not slowed by the turning operation.

In its broadest aspect, the turning mechanism also has application on other types of lower friction conveying surfaces or turning surfaces where speed of delivery into and out of the strapping station is not a high priority. It is most uniquely suited, however, to the combination with the lifting table of a low-friction surface to obtain the maximum benefits of high conveying speed and rotational speed for a strapping machine of the type capable of handling 60 bundles per minute through the strapping station.

BEST MODE FOR CARRYING OUT THE INVENTION

Figure 2:
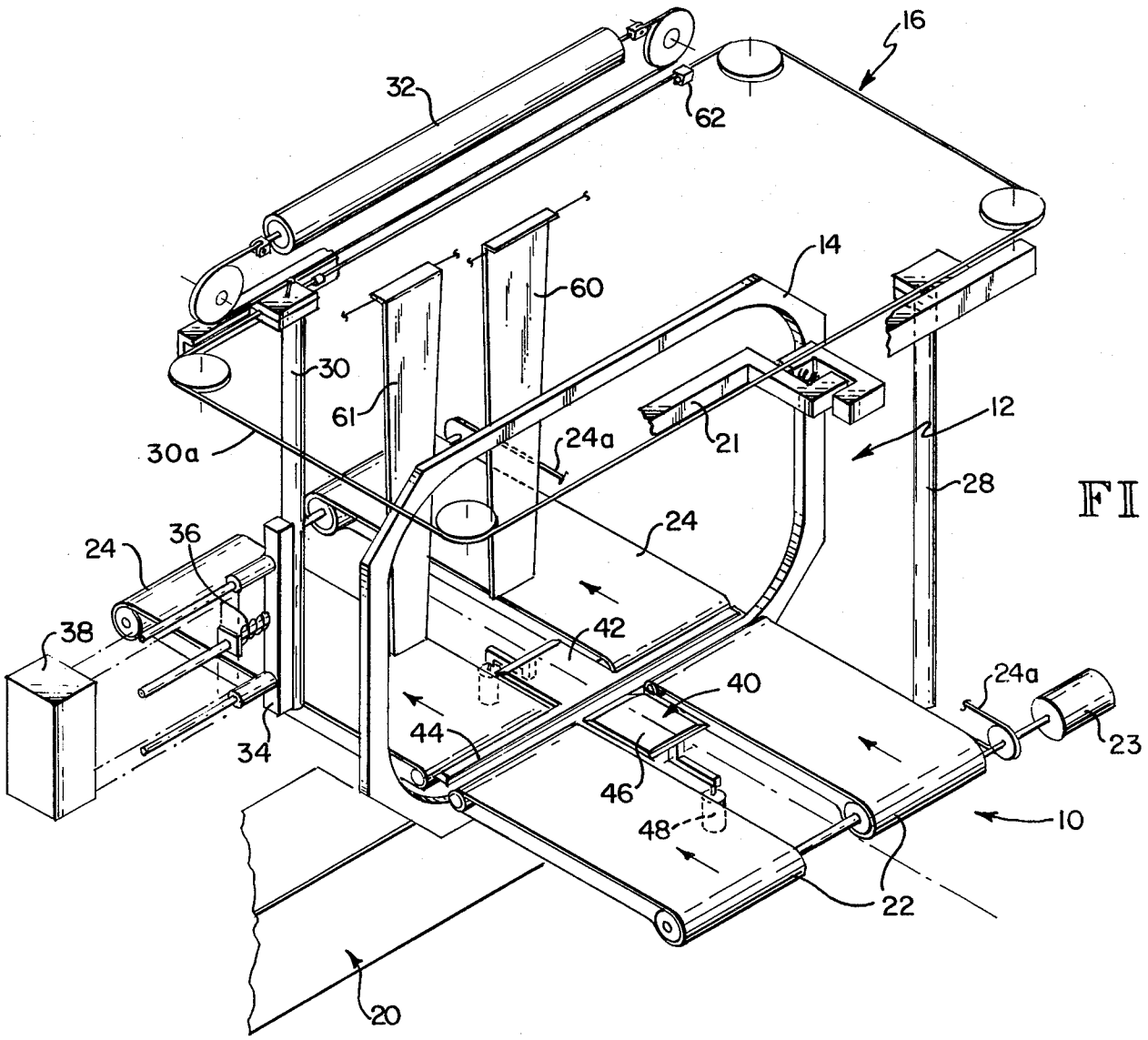
FIG. 2 is a schematic isometric illustrating a mechanism capable of carrying out the functional operations of FIGS. 1A–1F and embodying the principles of the invention.
Figure 3:
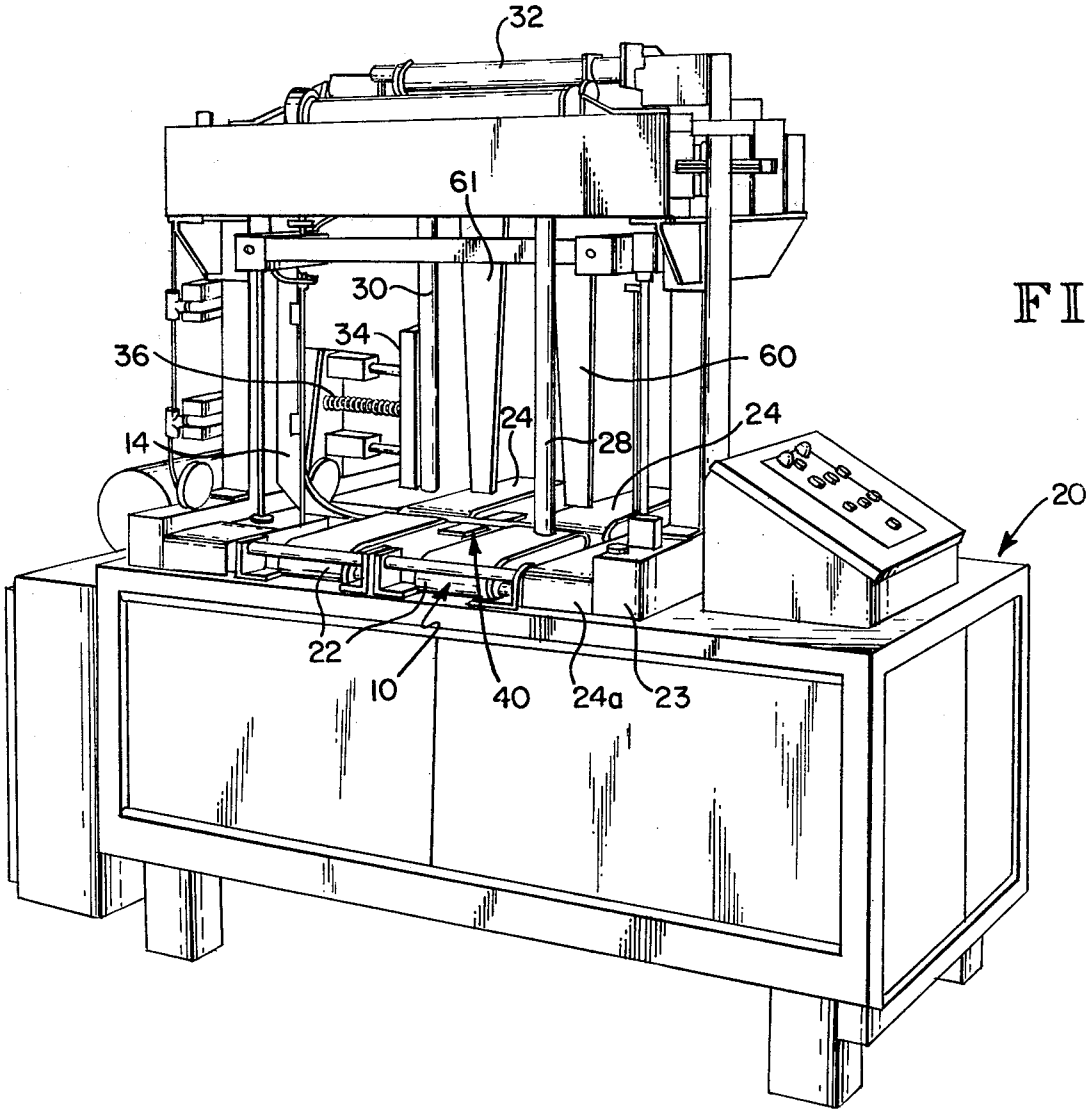
FIG. 3 is a perspective of a typical strapping machine embodying the principles of the invention.
Figure 4A:
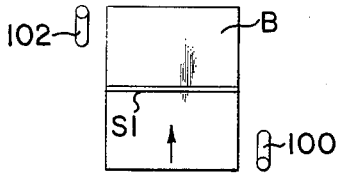
FIGS. 4A–4E are schematic operational diagrams of an alternate embodiment of the invention.
Figure 4B:
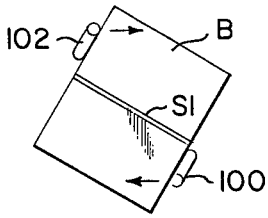
Figure 4C:
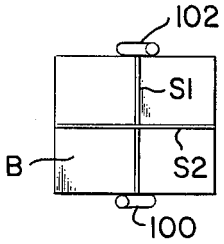
Figure 4D:
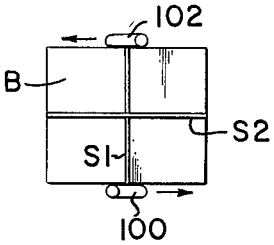
Figure 4E:
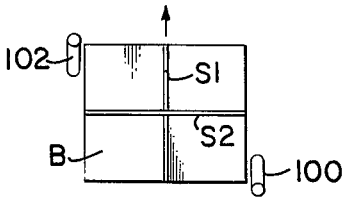

As is best shown in FIGS. 2 and 3, a high-speed strapping machine of the type shown in U.S. Pat. Nos. 4,120,239 and 4,201,127 is illustrated. In this type of equipment, an object is conveyed by a conveyor mechanism 10 to a strapping station 12 in which a strap or wire S1 is placed around the object or bundle B. At the strapping station, a turning apparatus 16 rotates the bundle ninety degrees and a second strap S2 is applied to the bundle. Finally, the conveyor 10 then moves the cross-strapped bundle out of the strapping apparatus.

The strapping apparatus at the strapping station includes a guide 14 which identifies the location of the strap line for the purposes of this invention. It should be understood that suitable strapping apparatus constructed in accordance with the teachings of U.S. Pat. No. 4,120,239 and identified schematically by reference numeral 20 delivers a bundle against stops 60, 61 to the strapping station 12, feeds a plastic strap around the bundle at the strapping station, compacts the bundle, if desired, tensions the strap tightly around the bundle, and finally, seals the tensioned strap on the bundle. A second strap may be fed into the strapping guide 14 prior to final sealing of the previous strap. Reference is made to this feeding of the second strap only as a point of reference to aid understanding the sequence of operations of the bundle-rotating mechanism of this invention.

The strapping station uses conveying mechanisms and a hold-down bar 21 of the type shown in U.S. Pat. No. 4,201,127 (which is incorporated by reference herein). The conveying mechanism includes an upstream, transversely spaced set of conveyors 22, having a high-friction conveying surface which will grip the bottom of the bundle for rapidly accelerating the bundle. A similar second set of transversely spaced conveyors 24 are located downstream from the upstream conveyors 22 for rapidly accelerating the bundle out of the strapping station. As is well understood, these conveyors are driven simultaneously by a suitable motor 23 and drive 24*a*.

Figure 1A:
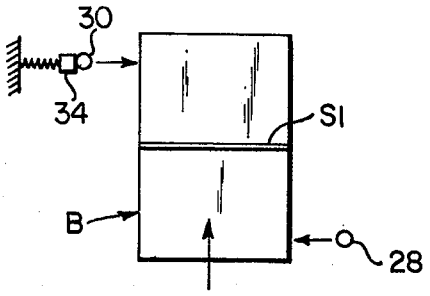
FIGS. 1A–1F are schematic operational diagrams illustrating the rotation sequence of an object, such as a stack of newspapers, in a strapping machine.
Figure 1B:
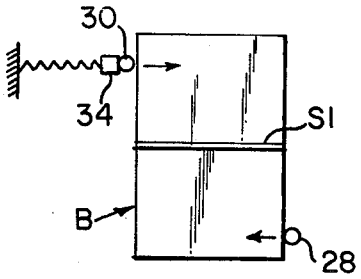
Figure 1C:
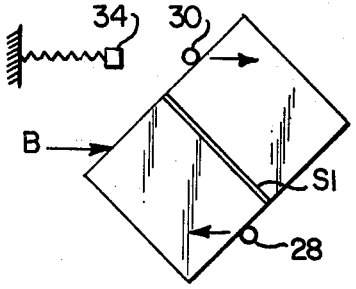
Figure 1D:
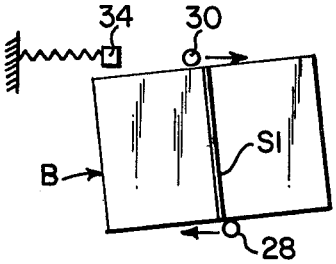
Figure 1E:
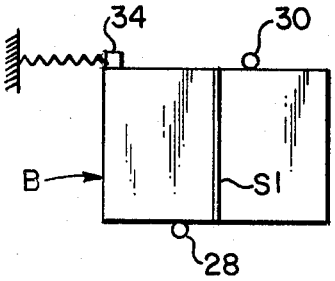
Figure 1F:
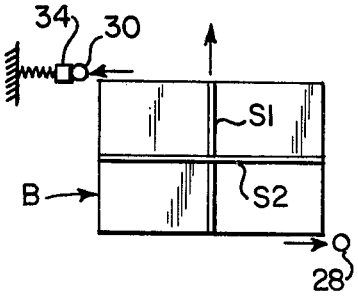

A turning apparatus 16 is best illustrated in FIG. 2 and includes two spaced, vertical turning posts or bars 28 and 30. The posts are spaced lengthwise of the conveyor a slightly greater distance than the width of the bundle to be turned and are adjustably positioned so as to be adjusted for various bundle widths. The posts are secured to a common cable 30*a* which is powered through a turning cylinder 32 to move the posts simultaneously. The posts are positioned to engage simultaneously opposite, laterally facing sides of the bundle at respective forward and rearward halves of the bundle relative to the length of the bundle so that by pushing against the laterally facing sides, the bundle is rotated through ninety degrees to the position shown in FIG. 1E. As the bundle rotates, an independent vertical stop post 34 becomes positioned against the same lateral side as the post 30, and thus is in alignment with the post 30. The three posts 28, 30 and 34 provide a triangulation or three-point engagement orientation on the bundle, bringing the bundle to a rapid stop in position for strapping. The stop post 34 is initially moved by a spring 36 against the post 30 (FIG. 1B) when the post 30 is moved by the turn cylinder 32. The spring 36 and block 38, however, limit the movement of the stop post 34 so that it becomes positioned as shown in FIG. 1E. The stop post is automatically retracted by post 30 as the post 30 is returned during a reverse stroke of the turn cylinder 32, as is shown in FIG. 1F.

A low-friction lifting mechanism 40 includes a downstream table 42 which is lifted by a cylinder 44 and an upstream table 46 which is lifted by a cylinder 48. The cylinders 44, 48 and 32 are preferably pneumatically powered. The space between the tables allows straps to be applied to the bundle.

In operation, the conveying mechanism 10 delivers the bundle to the strapping station, where it is stopped by posts 60 and 61 of the type shown in U.S. Pat. No. 4,201,127. The first strap or straps are applied. The air cylinders 48 are energized at a time just prior to sealing of the first strap, with a convenient time being selected as the initiation or feeding of a new strap into the strap guide 14. By the time the first strap has been completely sealed and is free to be moved with the bundle, the lifting tables 42 and 46 will begin to rise and lift the bundle. The bundle is lifted off the conveying surfaces and totally supported by the tables 42 and 46. The air pressure buildup in the cylinders 44 and 48 indicates that the tables are fully raised, and triggers the energization of turn cylinder 32 so that both turning posts 28 and 30 are moved against the object, as shown in FIGS. 1A and 1B. The stop post follows into the position shown in FIG. 1C and the bundle is fully rotated into the position shown in 1E.

A limit switch 62 on the turn cylinder signals the completion of rotation and immediately energizes the pneumatic supply to return the turn cylinder to its original position and to lower the tables 40 and 42. At this time, the bundle is back on the conveying surfaces 22 and 24, and the cross-strap is applied. After the cross-strap is applied, the bundle is removed by energizing the conveyors 22 and 24.

When tying bundles of newspapers having advertising inserts, the bars are elongated to resemble paddles 100 and 102 (as shown in FIGS. 4A–4E). The elongated bars provide larger surface areas of contact on the spaced, less packed edges of the papers in the bundle. That is, the broad face of each paddle contacts a larger area of the bundle, better insuring contact with a firm part of the bundle. In other respects the turning device is similar to that just described, except that the longer surface of the paddle integrally provides the three-point stop for triangulation or accurate positioning of the bundle. When the paddles retract to their starting position, they remain rotated until they nearly reach their destination.

Figure 5:
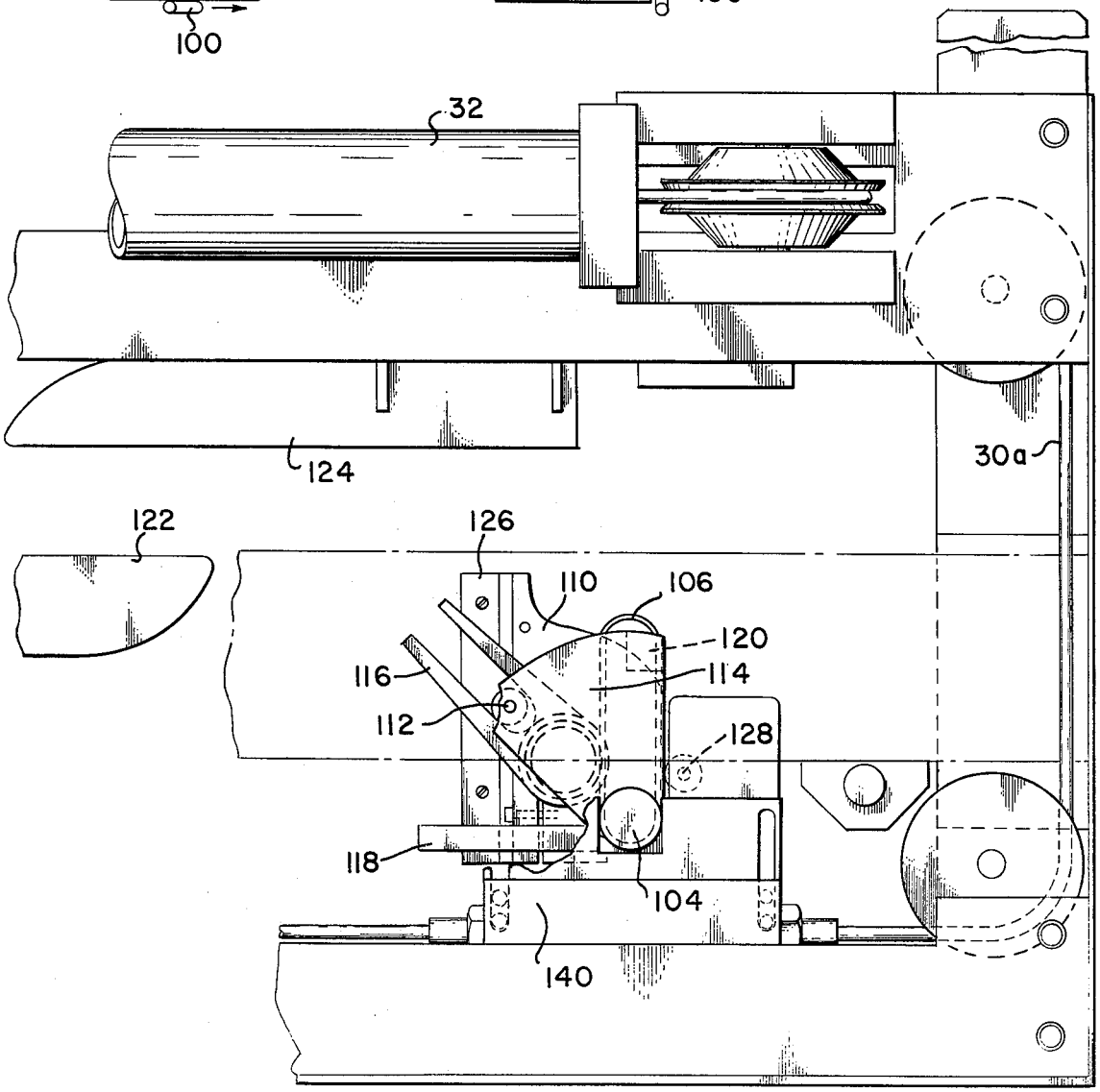
FIG. 5 is a detailed partial top plan of the alternate embodiment of this invention.
Figure 6:
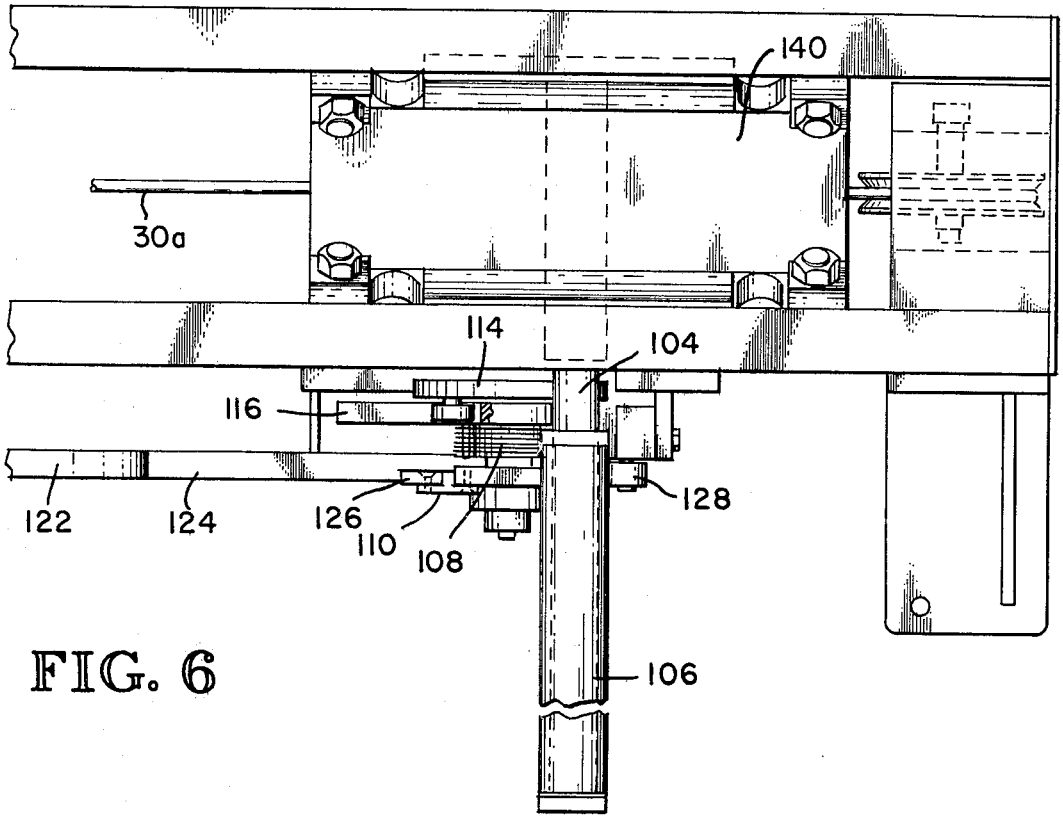
FIG. 6 is a partial side elevation of an alternate embodiment of this invention.
Figure 7:
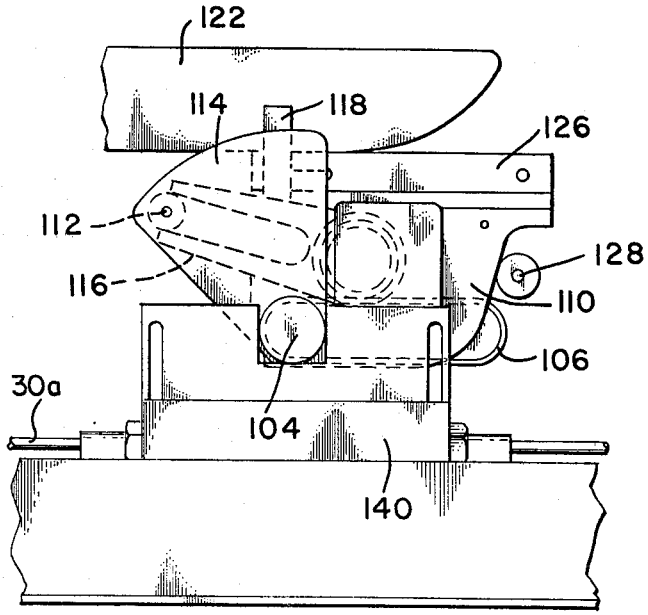
FIG. 7 is another detail similar to FIG. 5 showing the turning post rotated ninety degrees.

Referring now to FIGS. 5–7, each bar or paddle has an oval-shaped shroud 106 fixed to a shaft 104. The shaft is fixed to the carriage 140 while the shroud 106 is able to rotate relative to the shaft 104. The rotation of the shroud 106 is controlled with a slip clutch 108. The clutch may be set to a prescribed minimum force which need be attained before the shroud 106 will rotate. The clutch 108 is attached to the shroud 106 through a cam plate 110. Pivotally attached above the cam plate 110 in line with the clutch 108 is a forked cam 116 which swings with the rotation of the paddle. A cam follower 112 extends downwardly from a triangular plate 114 which is rigidly attached to shaft 104. The follower 112 rolls between the forks of the cam 116 as cam plate 110 and the paddle turn relative to triangular plate 114 and shaft 104. A stop surface 118 projects upwardly from the plate 110 and contacts a stop 120, which projects downwardly from plate 114, to insure that the shroud 106 only rotates ninety degrees. When fully rotated, the paddle serves as a stop. Because it contacts both halves of its side of the bundle, the triangulation orientation is maintained.

To insure that the paddle rotates substantially ninety degrees where the bundle is not of sufficient strength to rotate the paddle, a cam surface 122 is positioned on the frame to engage a wear strip 126 on the plate 110 as the paddle moves inwardly. When the carriage 140 returns to its starting position, a cam surface on the plate 110 contacts a reset roller 128 to return the paddle counterclockwise to its original position. Only when the reset roller is engaged will the shroud 106 begin to turn, the slip clutch 108 otherwise maintaining the paddle in its turned orientation. Cam surface 124 is positioned to contact the other paddle 102.

While preferred embodiments of the invention have been shown and described, it should be understood that variations will be apparent to one skilled in the art, and thus the invention is not to be limited to the specific embodiments illustrated in the drawings. For example, a second stop post can be added adjacent the turning post 28 for four-point positioning.

What is claimed is:

1. An object-turning apparatus for a high-speed strapping and conveying machine, comprising:

(a) conveying means having a high-friction conveying surface for rapidly moving an object into and out of a strapping station;

(b) at least two object-turning members at the strapping station spaced on opposite sides of the conveying surface and longitudinally spaced along the conveying surface for engaging the object on opposite sides, one member engaging the forward half and the other engaging the rearward half of the object;

(c) means for lifting the object off the conveying surface at the strapping station, the means having a low-friction surface to make rotation of the object easier;

(d) strapping means for placing a first strap around the object at the strapping station, and thence a second strap around the object after the object is rotated; and (e) means for moving the object-turning members simultaneously from their initial positions on opposite sides of the lifting means toward the other side of the lifting means to engage and to rotate the object, and stop means for positioning the bundle in its rotated position whereby the object is rotated by the object-turning members into at least a three-point triangular engagement position on the lifting means.

2. The apparatus of claim 1 wherein the stop means includes a stop surface separate from and aligned with an object-turning member on one side of the bundle, and contacts that half of the object remote from the half contacted by the object-turning member for providing triangulation engagement.

3. The apparatus of claim 1 wherein the lifting means has at least two longitudinally spaced tables defining a strapping line therebetween.

4. The apparatus of claim 2, the stop surface including a vertical post, means for pushing the post against the object-turning member, and means limiting the distance of movement of the post for positioning the post longitudinally of the conveyor to achieve the three-point alignment.

5. The apparatus of claim 1, the high-friction surface including two sets of transversely spaced conveyor belts, each set longitudinally spaced on either side of the strapping station.

6. The apparatus of claim 3, the high-friction surface including two sets of transversely spaced conveyor belts, each set longitudinally spaced on either side of said strapping line.

7. The apparatus of claim 3 wherein the means for lifting raises both tables simultaneously.

8. The apparatus of claim 1 wherein each object-turning member includes an elongated paddle to contact the object throughout its rotation and at least one paddle including a stop surface spaced on opposite sides of the centerline of the object from the pushing surface to provide the three-point triangular engagement when the object is turned.

9. The apparatus of claim 8 wherein each object-turning member further includes a slip clutch to allow swiveling of about ninety degrees against a predetermined friction pressure.

10. The apparatus of claim 9 wherein each object-turning member further includes a cam surface to contact and to rotate the paddle when the paddle moves inwardly and a reset roller to contact and to rotate the paddle when the paddle moves outwardly.

11. The apparatus of claim 9, said slip clutch including a first pivot post mounted on said paddle, a forked cam pivotally mounted on the first pivot post, friction discs interconnecting the post and forked cam, means for adjusting the slippage pressure of the discs and a roller within said forks and responsive to rotation of the paddle to pivot said forked cam whereby the drag between the friction discs is transmitted to the rotation of the paddle.

12. In a bundle-strapping machine of the type having an infeed conveyor and an outfeed conveyor on opposite sides of a strapping station, strapping means located in part below the conveyors at the strapping station for placing a strap tightly around the bundle, and bundle-turning apparatus at the strapping station, comprising:

a table having a bundle-supporting surface of lower friction than the conveyors, means for elevating the table to lift the bundle off the conveyors, downwardly depending turning posts spaced transversely and longitudinally of the conveyors at the strapping station, means for moving the posts transversely toward the center of the strapping station simultaneously for engaging the bundle and rotating the bundle, wherein each post includes a large area, elongated bundle-engaging surface with the length of the surface of at least one of the posts in the direction parallel to the side of the bundle extending on opposite sides of the centerline of the bundle when the bundle is turned whereby the bundle will be engaged at least at three spaced, triangularly located points, and means for stopping the rotation of the bundle whereby the triangulation and stopping of the bundle assures the bundle gets turned accurately ninety degrees.

13. A turning mechanism for rotating horizontally conveyed objects ninety degrees on a conveyor mechanism, comprising:

(a) conveying means for moving the object along a path, including longitudinally and transversely spaced, high-friction conveyor surfaces, lifting means having a low-friction surface, and means for raising and lowering the lifting means to raise the object off the conveyor surfaces during rotation of the object;

(b) first means for engaging and moving a forward half of one side of the object transversely of the conveyor means in a first direction, (c) second means for engaging and moving a rearward half of a second opposite side of the object transversely of the conveying means in a second direction opposite the first direction, either the first or second means also including a stop means for engaging the object in at least three triangularly positioned points, and (d) means for actuating the first and second means simultaneously whereby the object is turned and positioned in a single movement.

14. The mechanism of claim 13 wherein the first and second means each includes a vertical bar and the stop means is separate and spaced from the bar on the same side of the object for providing the three triangularly positioned points.

15. The mechanism of claim 14, further including means for strapping the object, and wherein the lifting means includes longitudinally spaced tables defining a strapping area therebetween, and the means for raising and lowering the lifting means raises and lowers both tables simultaneously.

16. An apparatus for turning bundles of newspapers ninety degrees on a conveyor, comprising:

(a) a conveyor for moving the bundle along a path;

(b) first means for engaging and moving a forward half of one side of the object transversely of the conveyor means in a first direction;

(c) second means for engaging and moving a rearward half of a second opposite side of the object transversely of the conveying means in a second direction opposite the first direction, either first or second means including stop means for engaging the object in at least three triangularly positioned points; and (d) means for actuating the first and second means simultaneously whereby the object is turned and positioned in a single movement, wherein the first and second means for engaging contact the bundle with surfaces that are substantially parallel to the sides of the bundle at the moment of contact.

* * * * *